US005390093A

United States Patent [19]

Himeno et al.

[11] Patent Number: 5,390,093

[45] Date of Patent: Feb. 14, 1995

[54] ILLUMINATING DISPLAY DEVICE FOR USE WITH A MOSAIC PANEL

[75] Inventors: Tomiharu Himeno; Shoji Kohsaka, both of Hyogo, Japan

[73] Assignee: K.C.C. Shokai Limited, Hyogo, Japan

[21] Appl. No.: 198,858

[22] Filed: Feb. 18, 1994

[51] Int. Cl.[6] ..... F21V 29/00

[52] U.S. Cl. ..... 362/249; 362/241; 362/294; 362/800; 40/452

[58] Field of Search ..... 362/241, 234, 235, 237, 362/240, 244, 245, 246, 247, 249, 294, 800, 373, 812; 313/500; 40/452, 550, 564

[56] References Cited

U.S. PATENT DOCUMENTS

| | | | |
|---|---|---|---|
| 3,291,975 | 12/1966 | McCullough et al. | 362/235 |
| 3,451,681 | 6/1969 | Rossetti | 40/452 |
| 4,234,914 | 11/1980 | Boesen | 362/240 |
| 4,254,453 | 3/1981 | Mouyard et al. | 362/240 |
| 4,390,810 | 6/1983 | Biwa | 313/500 |
| 4,887,074 | 12/1989 | Simon et al. | 313/500 |

*Primary Examiner*—Ira S. Lazarus
*Assistant Examiner*—Y. Quach
*Attorney, Agent, or Firm*—Koda and Androlia

[57] ABSTRACT

Disclosed is an illuminating display device for use with a mosaic panel, in which necessary display devices, measuring instruments, and the like are mounted to a crosswise-shaped metallic grid, to form a panel surface, and on which light-emitting diodes are arranged at a high density to afford a high-luminance display surface. The illuminating display device prevents the display surface and the interior of the display device from increasing in temperature to high due to heat generated by a large number of light-emitting diodes. The whole illuminating display device is composed of a base frame (4) mountable to and removable from the grid, and a circuit board (5) and a reflector (6) to be mounted on the base frame. The base frame (4) is composed of a leg (4*b*), which is in face-to-face contact with a partitioning wall (2*a*) of the grid and which is engaged with the grid by its engaging claw (4*c*), and a base seat (4*a*) on which a circuit board and others are mounted, wherein the base seat (4*a*) and the leg (4*b*) are made of metal and integrally provided. By this arrangement, heat generated by illumination of the light-emitting diodes is conducted via the base frame to the metallic grid, thus effectively radiated as a whole.

4 Claims, 5 Drawing Sheets

ILLUMINATING DISPLAY DEVICE FOR USE WITH A MOSAIC PANEL

BACKGROUND OF THE INVENTION

1. Field of the Invention

Known distribution panels or display panels include those called mosaic panels. On the panel surface of such mosaic panels, necessary display devices, measuring instruments, and the like are arranged on square paths of a grid formed into a lattice, crosswise in length and breadth, by using metal materials such as aluminum die cast or zinc aluminum die cast. Also known as display devices for these mosaic panels are illuminating display devices which implement illuminating display by means of a light source such as a light-emitting diode.

The present invention relates to illuminating display devices for use with a mosaic panel and, more particularly, to an illuminating display device which allows light-emitting diodes to be arranged at high densities and which can be mounted to or removed from the grid.

2. Description of the Prior Art

Conventional illuminating display devices have usually been provided in the following arrangement. As shown in FIG. 6, necessary display device is prepared as a through hole C in the surface of a blind tile B that can be mounted to or removed from a metallic grid A. Then an acrylic plate D having a light-pervious property is fitted into the through hole C. Further, an illuminating unit F which implements illumination with a relatively small number of light-emitting diodes E is fitted behind the tile B.

An illuminating unit is also known in which the portion corresponding to the tile B in FIG. 6 and the casing of the illuminating unit F are molded integrally together and an engaging piece is molded to the casing for engagement with the grid.

Still also known is a high-density illuminating display device, as shown in FIG. 7, in which a large number of light-emitting diodes E, E are arranged on a circuit board G at a high density as much as 16 dots in length and breadth each, for example. Conventional high-density illuminating display devices are, in general, arranged not to be mountable and removable to the grid of the mosaic panel, but to be fixedly arrayed by clamping with screws, each of the illuminating display devices being utilized primarily to display characters and others by combinations of light sources thrown into light emission.

The conventional illuminating display device in combination of the tile B and the illuminating unit F would result in a relatively low luminance because of a small number of light-emitting diodes. To make this illuminating display device higher in luminance and therefore easier to view, it may be arranged that the light-emitting diode itself is made higher in capacity or that, as indicated by two-dot chain lines in FIG. 7, a circuit board having the light-emitting diodes disposed thereon at a high density is accommodated in the tile.

However, if the circuit board G having the light-emitting diodes E arrayed thereon at a high density was accommodated in the tile B as shown in FIG. 7, heat generated by the light-emitting diodes E would accumulate dense within the tile B, adversely affecting the driving unit and others. Similarly, if high-capacity light-emitting diodes were accommodated in the illuminating unit F or in the integrated casing of the illuminating unit, heat would accumulate inside.

In particular, when illuminating display devices of high capacity having light-emitting diodes arrayed thereon at a high density are arrayed in a large number adjacent to the panel surface, as shown in FIG. 2, it has been established that the temperature of the illuminating display surface can reach approximately 80° C. due to heat generated by the light-emitting diodes.

SUMMARY OF THE INVENTION

In view of such a fact, the present invention has developed an illuminating device which has light-emitting diodes arranged thereon at a high density and in which generated heat is dissipated effectively.

According to the illuminating display device for a mosaic panel as claimed in claim 1, there is provided an illuminating display device which is capable of bright surface illumination by the use of a large number of light-emitting diodes, and which effectively radiates heat generated by the light-emitting diodes, from the metallic base frame into the grid or the atmosphere, thereby preventing the illuminating display surface and the interior of the illuminating display device from increasing in temperature to high, and thus preventing the driving unit for the light-emitting diodes and others from being adversely affected by heat.

According to the illuminating display device as claimed in claim 2, there is provided an illuminating display device which is capable of dotted display by the use of a large number of light-emitting diodes and which effectively radiates heat generated by the light-emitting diodes, from the metallic base frame into the grid or the atmosphere, thereby preventing the illuminating display surface and the interior of the illuminating display device from increasing in temperature too high, and thus preventing the driving unit for the light-emitting diodes and others from being adversely affected by heat.

According to the illuminating display device as claimed in claim 3, there is provided an illuminating display device which can be simplified in the manufacturing process of the base frame of the illuminating display device and, besides, which allows the base seat 4*a* and leg 4*b* of the base frame to be made from their respectively suitable materials in terms of their functions.

An illuminating display device 1 that is mountable to and removable from a lattice-shaped, metallic grid 2 is composed of a base frame 4 for mounting to the grid, and a circuit board 5 to be mounted to the base frame 4, and a reflector 6.

The base frame 4 is provided by integrally forming a flat leg 4*b* and a base seat 4*a* together, the flat leg 4*b* penetrating a square path 3 of the lattice-shaped grid 2 and making face-to-face contact with a partitioning wall 2*a* of the grid, the leg also having at one end thereof an engaging claw 4*c* for engagement with the grid, and the base seat 4*a* being located on the surface of the square path of the grid, and by materializing this integration with a metal. Thus, the base frame 4 is made of a metal and mountable to and removable from the grid.

On the top face of the base seat 4*a* of the base frame 4 is fixed a circuit board 5 on which a large number of light-emitting diodes 9, 9 mounted on the surface. Ahead of the circuit board 5, a reflector 6 is mounted to guide light of the light-emitting diodes 9 forward. To the reflector 6, an illuminating plate having a light-pervious property is fitted so as to be spaced from the light-emitting diodes on the circuit board 5 at a specified interval or in proximity thereto.

When the large number of light-emitting diodes 9, 9 arranged on the circuit board 5 at a high density are lit, heat generated by the individual light-emitting diodes 9 reaches a considerable quantity as a whole. The heat generated by the light-emitting diodes is conducted from the circuit board, via the metallic base frame 4, which is a good thermal conductor, i.e. the base seat 4*a* and the leg 4*b*, to the metallic grid 2 with which the leg is in contact. As a result, the heat is dispersed to the entire grid 2, while it is also radiated from the surfaces of the base seat 4*a* and leg 4*b* of the base frame 4 that is in contact with external air.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PREFERRED EMBODIMENTS

Embodiments of the illuminating display device for use with a mosaic panel according to the present invention will now be described with reference to the accompanying drawings.

Figure 2:
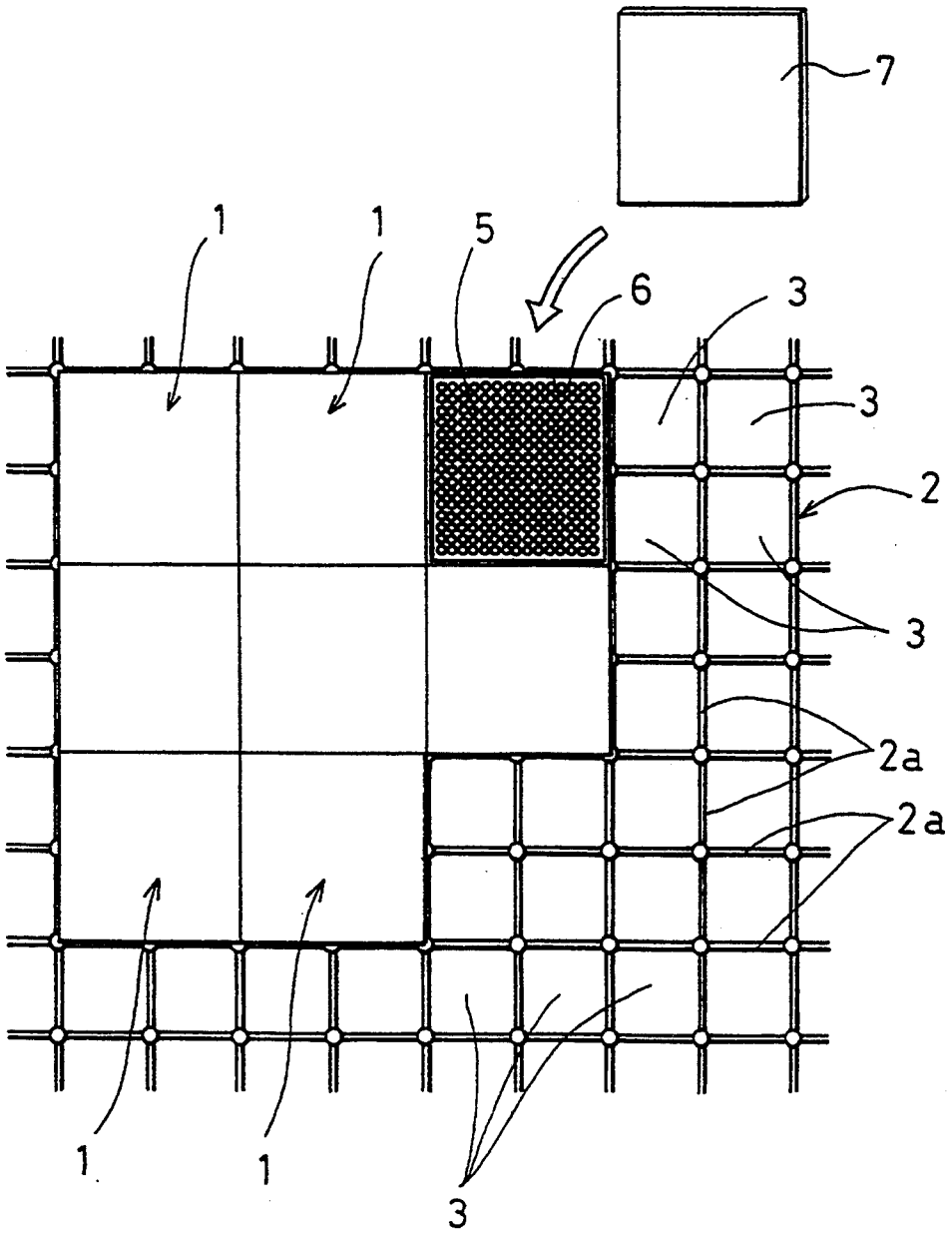
FIG. 2 is a partly front view of a mosaic panel to which the illuminating display device is mounted.

An illuminating display device 1 according to the present invention is made mountable to and removable from square paths 3, 3 of a grid 2 formed into a lattice shape, crosswise in length and breadth, and integrally molded from a metal material such as aluminum die cast or zinc aluminum die cast. FIG. 2 depicts an embodiment in which the illuminating display device is so set in size that one device corresponds to two pitches each in length and breadth of the square path 3 of the grid 2, i.e. such illuminating display devices are arrayed with no clearances in the units of four square paths 3, 3. Of course, instead, the illuminating display device may be of such a size that one square path 3 corresponds to one illuminating display device.

Figure 1:
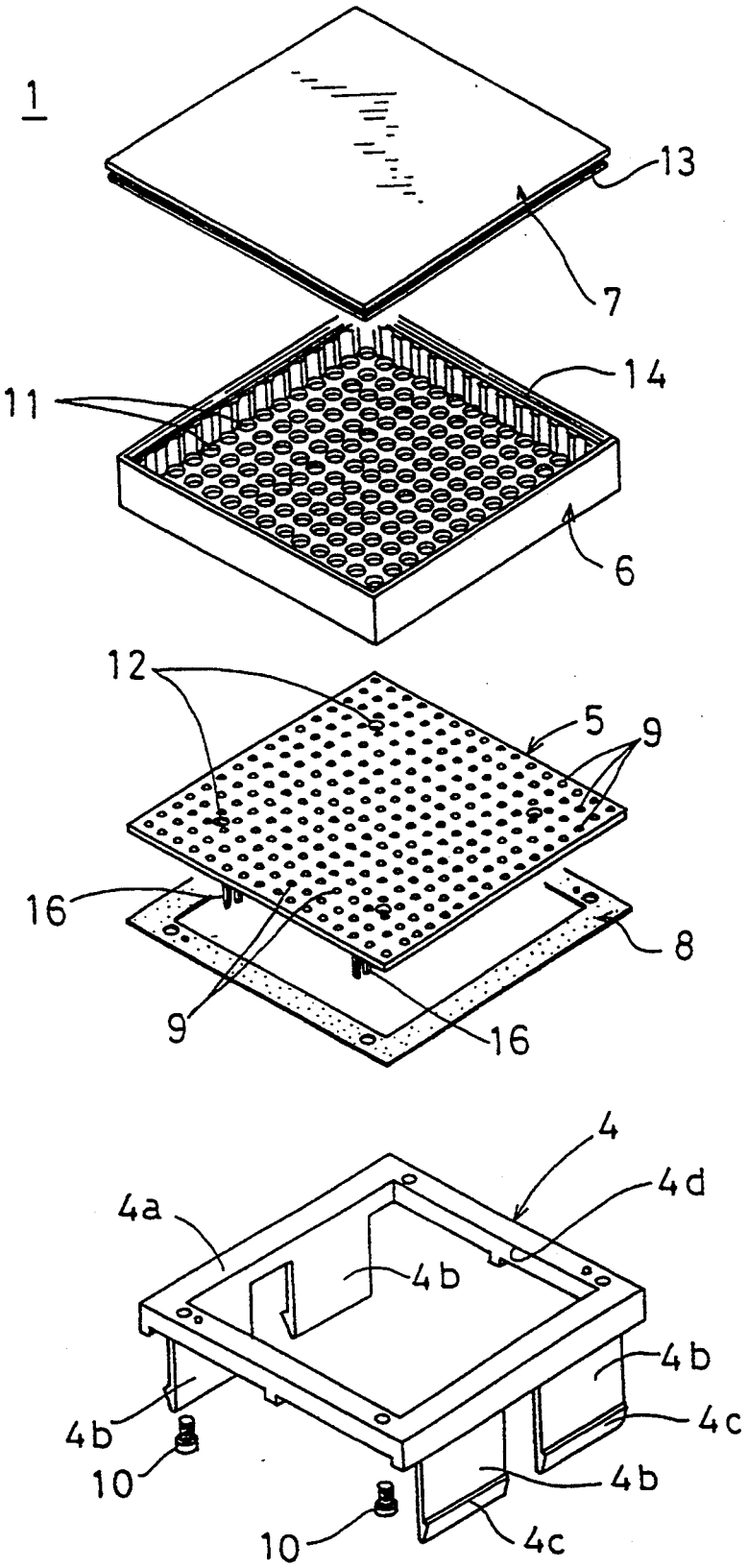
FIG. 1 is an exploded perspective view of an illuminating display device according to the present invention.
Figure 3:
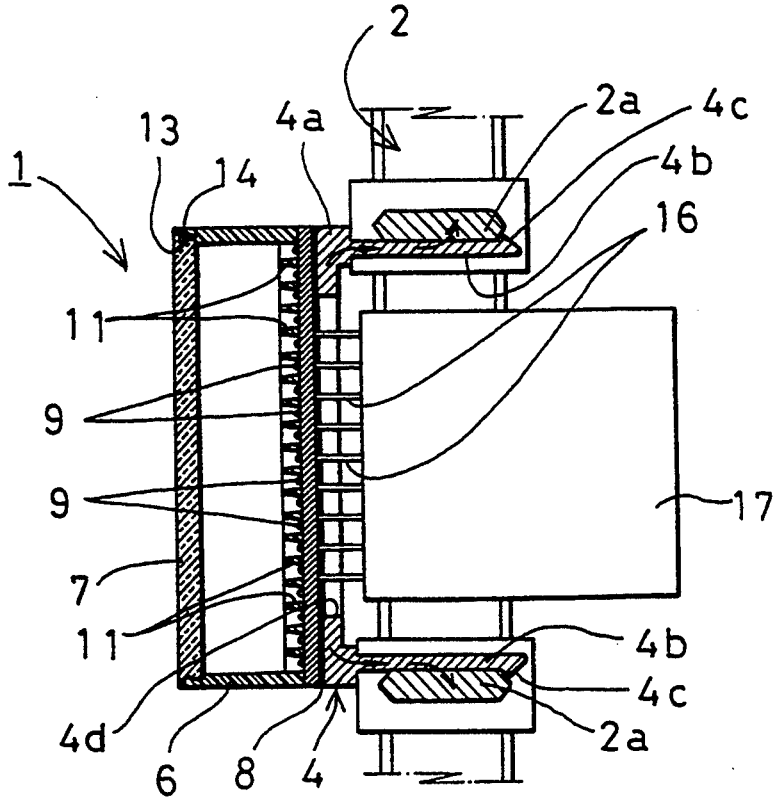
FIG. 3 is a longitudinal sectional view of the illuminating display device of the invention in a state that it is mounted to the grid.

One illuminating display device 1, as shown in FIG. 1 or 3, is composed of a base frame 4, a circuit board 5 mounted on a surface of the base frame 4, a reflector 6 mounted on the circuit board 5, and an illuminating plate 7 removably mounted at the front end of the reflector 6. In addition, in the case illustrated in the drawings, there is interposed an insulating mat 8 having a relatively high thermal conductivity between the base frame 4 and the circuit board 5.

The base frame 4 is formed by integrally molding the base seat 4*a* and the leg 4*b* with a metal material having a relatively high thermal conductivity, for example, an aluminum alloy. The base seat 4*a* is shaped into a square the size of which depends on the unitary pitch size of the grid 2. The leg 4*b* is arranged to penetrate through square paths 3 as it is in face-to-face contact with the partitioning wall 2*a* of the grid, and has at its one end an engaging claw 4*c* for engaging with the partitioning wall 2*a* of the grid by the rear at the rear face. Consequently, the leg 4*b* is formed into a plate thinner than the base seat 4*a* and flat and flexible, and subjected to heat treatment so that the plate becomes engageable with the grid by elasticity.

The base seat 4*a* of square shape is made relatively thick, and formed into the square frame by cutting off a through hole 4*d* in its center. This through hole 4*d* is necessary to provide electrical connection means to the circuit board 5 and the like and is effective in that the circuit board 5 is exposed directly to the atmosphere with heat of the circuit board directly dissipated into the atmosphere. Also, the through hole 4*d* allows the base seat 4*a* to be in contact with the atmosphere at an increased area.

The circuit board 5 to be fixed at the base seat 4*a* of the base frame 4 is a light-emitting plate having on its surface a large number of light-emitting diodes 9 arrayed in a matrix. This circuit board 5, containing necessary electric circuits and others, may preferably be provided by an aluminum board made from a material of aluminium. The base frame 4 and the circuit board 5 may be fixed together by securing the circuit board 5 at the base seat 4*a* of the base frame 4 with screws 10, 10.

The reflector 6 to be mounted on the circuit board 5 is formed into a tray-like shape the overall size of which coincides with that of the circuit board 5, and has a large number of through holes 11 bored at such positions as to each correspond to the positions of the light-emitting diodes when overlaid on the circuit board. These through holes make paths of light rays from the light-emitting diodes 9.

The reflector 6 may be mounted onto the circuit board 5 by fixing them by using any arbitrary means, such as bonding or adhesion. For example, it is properly arranged that a protrusion (not shown), provided on the bottom face of the reflector 6, is engaged with an engaging hole 12 of the circuit board 5 so that the light-emitting diodes 9 on the circuit board 5 and the through holes 11 of the reflector 6 can be kept in alignment with each other.

According to the embodiment as shown in FIGS. 1 and 3, an illuminating plate 7 having a light-pervious property is made mountable to and removable from the open end of the reflector 6 by concave-convex fitting. This illuminating plate 7 is coarse-surface finished so as to diffuse light as in frosted glass, and located at a position apart from the light-emitting diodes 9 on the circuit board by an extent of the thickness of the reflector 6. Accordingly, in this state, the light from the whole light-emitting diodes is diffused within the reflector 6, while light is also diffused at the surface of the illuminating plate, so that the whole illuminating plate can be illuminated uniformly with brightness.

Figure 4:
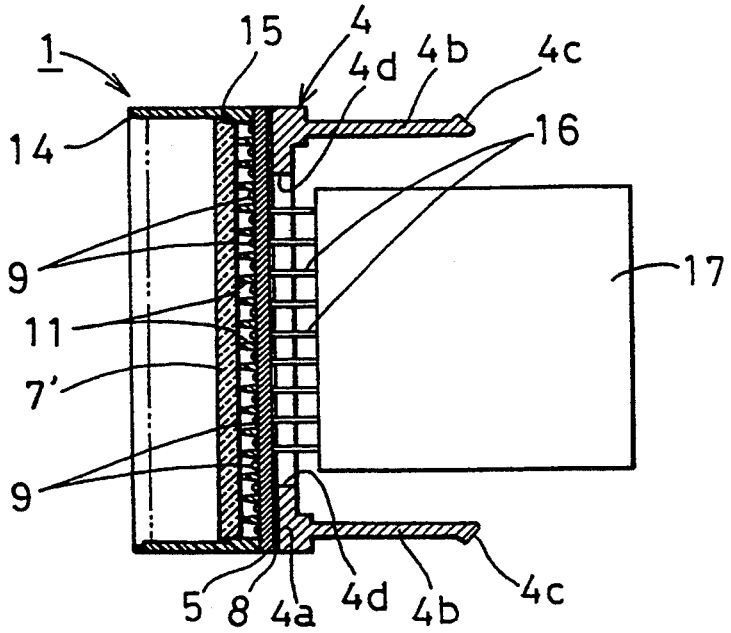
FIG. 4 is a longitudinal sectional view of the illuminating display device of the invention mounted to the grid in a state that the illuminating plate is mounted close to the light-emitting diodes.

FIG. 4 illustrates an embodiment of the invention in which an illuminating plate 7' is mounted close to the internal bottom face of the reflector 6, i.e., close to the light-emitting diodes 9. In this arrangement, light emitted from a large number of light-emitting diodes will pass through the illuminating plate 7' without being diffused, so that it can be visualized as a pointed light source as viewed from the front. Accordingly, it is possible to prepare numerals, characters, or symbols, as required, into display, by flickering control of the large number of light-emitting diodes.

In order to make the illuminating plate 7 mountable to and removabel from the open end of the reflector 6, engaging steps 13 and 14 are formed at the outer circumferential face of the illuminating plate 7 and the inner circumferential face of the reflector 6, respectively. Also, in order to make the illuminating plate 7' mountable to and removable from the internal deep portion of the reflector 6, a step 15 for engagement is formed inside the reflector.

In the embodiment shown in FIG. 4, engaging steps 14 and 15 are formed at two positions, i.e. the open end and an internal deep portion of the reflector 6 so that either the illuminating plate 7 or the illuminating plate 7' can be mounted at either one of the two positions as the case may be.

At the rear side of the circuit board 5 of the light-emitting diodes, as shown in FIGS. 3 and 4, circuit board lead wires 16 protrude, so that they protrude from the through holes 4*d* of the base frame 4 to its rear face so as to be connected to a driving unit 17 for the light-emitting diodes.

While part of the heat generated to the circuit board 5 with illumination of the light-emitting diodes is radiated from the surface of the reflector 6, most of the heat is conducted, as indicated by arrow in FIG. 3, via the base seat 4*a* of the base frame 4, which is a metal, i.e. good thermal conductor, the leg 4*b*, and the metallic grid 2, which is also a good thermal conductor, with the result that heat is dispersed to the whole grid. Besides, another part of heat is radiated from the surface of the circuit board 5 and the surface of the base frame 4 into the atmosphere. Accordingly, heat will not accumulate inside the illuminating display device 1, thus preventing the driving unit 17 and others from being adversely affected in thermal way to a substantial extent.

Figure 7:
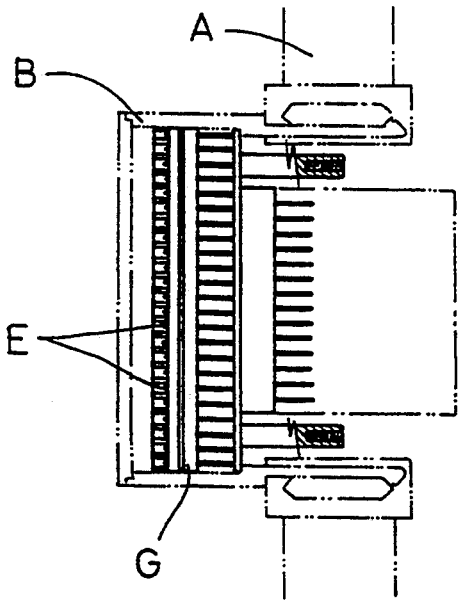
FIG. 7 PRIOR ART
FIG. 7 is a side view illustrating an example of the conventional illuminating display device incorporating a large number of light-emitting diodes.

According to the studies by the present inventors, it has been established that in the state as indicated by two-dot chain line in FIG. 7, i.e. in which the circuit board having light-emitting diodes mounted thereon at a high density is fitted to the tile, whereas it was that case ever seen that the illuminating display surface would increase in temperature up to approximately 80° C., when the same display was effected with the illuminating display device according to the embodiment of the invention, the temperature of the illuminating display surface could be suppressed to 60° C. or lower.

As shown in FIG. 1 or 3, it is preferable that the base frame 4 is integrally molded with a metal material superior in thermal conductivity in terms of heat transfer. The base frame 4 can be integrally manufactured with simplicity, for example, by die-cast processing an aluminum alloy, or cutting a molding material made of an aluminum alloy and approximately U-shaped in section into specified dimensions and then machining around the portions which are to serve as the leg and further subjecting the leg portions to heat treatment such as age-hardening treatment.

Figure 5:
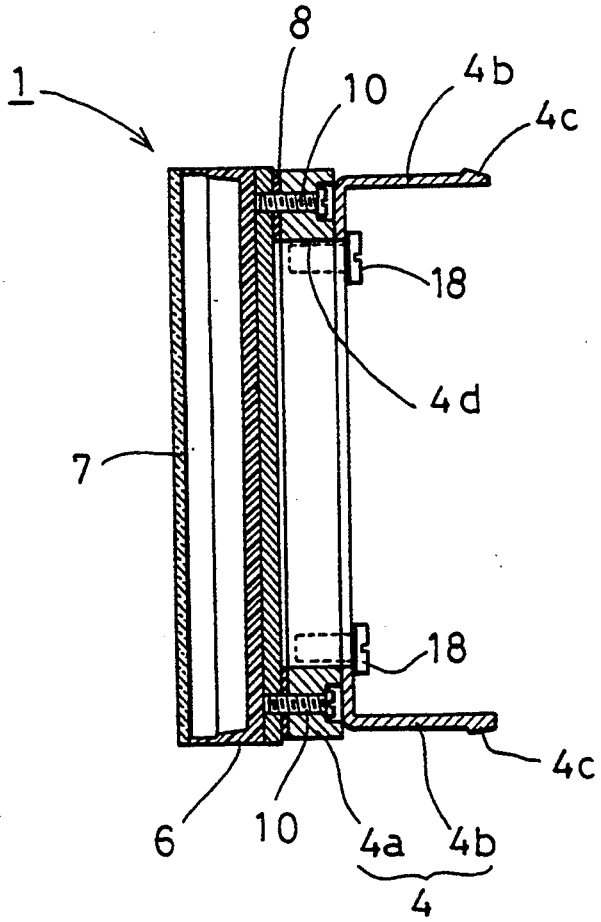
FIG. 5 is a longitudinal sectional view of an illuminating display device comprised of two components, a base frame and a base seat.
Figure 6:
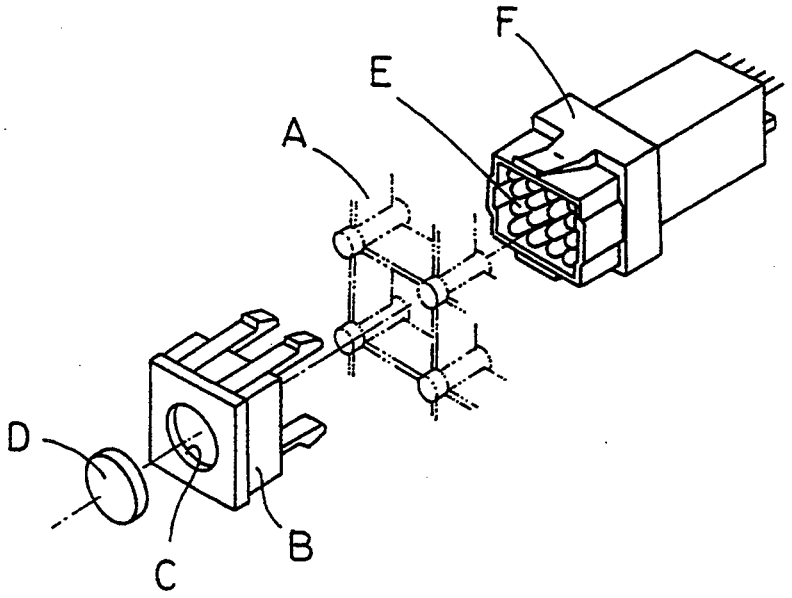
FIG. 6 PRIOR ART
FIG. 6 is an exploded perspective view illustrating an example of the conventional illuminating display device.

It is also possible, however, that, as shown in FIG. 5, the base seat 4*a*, on which the circuit board 5 and others are to be placed or mounted, and the leg 4*b*, which is to be engaged with the grid and made mountable thereto and removable therefrom, are manufactured separately of each other, and the base seat 4*a* and the leg 4*b* are connected and fixed with screws 18. With this method adopted, the construction of the members involved would be relatively simple, allowing them to be manufactured simply by press working or the like and further allowing the base seat 4*a* and the leg 4*b* to be made of their respectively suitable materials, for example, a spring material superior in elasticity for the leg.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. An illuminating device for use with a mosaic panel, comprising:

a base frame (4) having a plurality of flat legs (4*b*) and a base seat (4*a*) formed thereon of high thermal conductive material, each of the flat legs (4*b*) penetrating through a square path (3) of a lattice-shaped, metallic grid (2) and making face-to-face contact with a partitioning wall (2*a*) of the grid and further having an engaging claw (4*c*) formed at one end thereof to engage the partitioning wall of the grid, the base seat (4*a*) being located on a square path surface of the grid, and the base frame (4) being arranged to be mountable and removable from the grid and being made of a metal, wherein a circuit board (5) on which a large number of light emitting diodes (9, 9) are to be mounted is fixed at an upper face of the base seat (4*a*) of the base frame, a reflector (6) having holes therein through which said light-emitting diodes (9, 9) extend for reflecting light of said light-emitting diodes (9) forward is mounted on the circuit board (5), and an illuminating plate (7) having a light-pervious property is mounted a front end of the reflector (6) so as to be spaced from the light-emitting diodes (9, 9) on the circuit board (5) at a specified interval.

2. An illuminating display device for use with a mosaic panel, comprising:

a base frame (4) having a plurality of a flat legs (4*b*) and a base seat (4*a*) formed thereon of a high thermal conductive material, each of the flat leg (4*b*) penetrating through a square path (3) of a lattice-shaped, metallic grid (2) and making face-to-face contact with a partitioning wall (2*a*) of the grid and further having an engaging claw (4*c*) formed at one end thereof to engage the partitioning wall of the grid, the base seat (4*a*) being located on a square path surface of the grid, and the base frame (4) being arranged to be mountable to and removable from the grid and being made of a metal, wherein a circuit board (5) on which a large number of light-emitting diodes (9, 9) are to be mounted is fixed at an upper face of the base seat (4*a*) of the base frame, a reflector (6) having holes therein through which said light-emitting diodes (9, 9) extend for reflecting light of said light-emitting diodes (9) forward is mounted on the circuit board (5), and an illuminating plate (7') having a light pervious property is mounted on the reflector (6) close to the light-emitting diodes (9, 9) on the circuit board (5).

3. An illuminating display device for use with a mosaic panel as claimed in claim 1 or 2, wherein the legs (4*b*) and the base seat (4*a*) are formed separately of each other and joined together.

4. An illuminating device according to claim 1 or 2, further comprising an insulating mat provided between the circuit board and the base frame, said insulating mat (8) being made from an electrically insulating material which is also high in thermal conductivity.

* * * * *